US006282862B1

(12) United States Patent
Weeks

(10) Patent No.: US 6,282,862 B1
(45) Date of Patent: Sep. 4, 2001

(54) STRUCTURAL MEMBER

(75) Inventor: Kevin William Weeks, Glandore (AU)

(73) Assignee: Weeks Peacock Quality Homes PTY, Ltd., Glandore (AU)

( * ) Notice: Subject to any disclaimer, the term of this patent is extended or adjusted under 35 U.S.C. 154(b) by 0 days.

(21) Appl. No.: 09/367,054

(22) PCT Filed: Apr. 30, 1998

(86) PCT No.: PCT/AU98/00316

§ 371 Date: Aug. 6, 1999

§ 102(e) Date: Aug. 6, 1999

(87) PCT Pub. No.: WO98/49409

PCT Pub. Date: Nov. 5, 1998

(30) Foreign Application Priority Data

Apr. 30, 1997 (AU) ..... PO 6500

(51) Int. Cl.[7] ..... E04C 3/02

(52) U.S. Cl. ..... 52/731.3; 52/731.1; 52/731.7

(58) Field of Search ..... 52/731.1, 731.3, 52/731.4, 731.7, 731.8, 732.2, 639, 640, 643, 691, 729.2, 729.5

(56) References Cited

U.S. PATENT DOCUMENTS 2,356,309 * 8/1944 Garbe ..... 52/731.3 X
3,332,197 * 7/1967 Hinkle ..... 52/731.3
3,890,755 * 6/1975 Specht ..... 52/731.7 X
5,457,927 10/1995 Pellock et al. .
5,464,302 * 11/1995 Menchetti ..... 52/731.1 X
5,983,589 * 11/1999 Daudet ..... 52/640

FOREIGN PATENT DOCUMENTS 357930 3/1990 (EP) .
1137631 5/1957 (FR) .
2062060 5/1981 (GB) .

* cited by examiner

*Primary Examiner*—Daniel P. Stodola
*Assistant Examiner*—Erica B. Harris

(57) ABSTRACT

The present invention relates to a structural member (10) for the use as a chord (41, 42) for forming a roof truss (40) for a building. The invention in one aspect broadly resides in an elongated open structural (10) member having a cross section including a minor flange (12), a major flange (13), and a web (14) interconnecting said flanges and having a section axis (11*a*) at right angles to the longitudinal axis (11*b*) of the structural member (10) and passing through the flanges (12, 13) and wherein said web (14) includes a linear portion (17) substantially coincident with the section axis (11*a*) and a divergent portion (18) which extends to one side of said section axis (11*a*); said minor flange (12) extends to said one side of said section axis (11*a*); said major flange (13) extends from said portion (18) to the opposite side of said section axis (11*a*), and the section configuration being such that an inverted and reversed corresponding open member is nestable within open structural member (10) with their respective linear section portions (17) alongside one another and with each minor flange (12) located in an abutting relationship against the underside of the adjacent major flange (13).

23 Claims, 12 Drawing Sheets

FIG. 6b
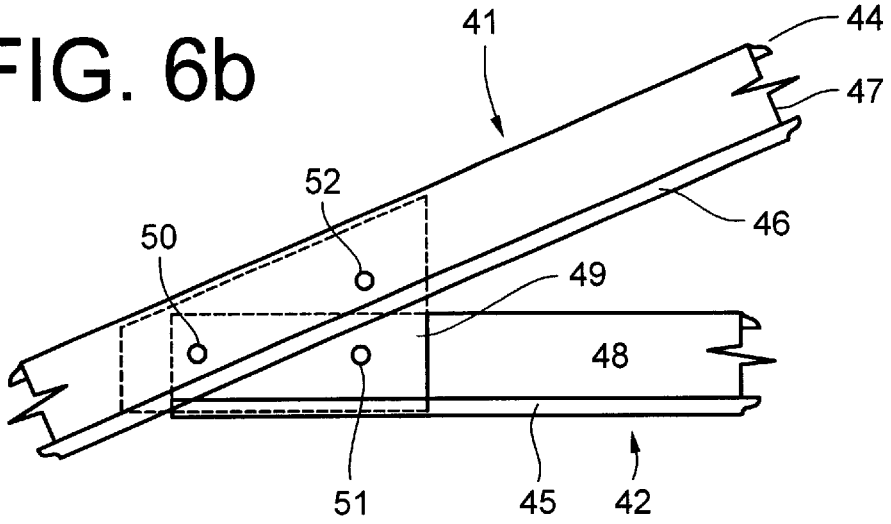
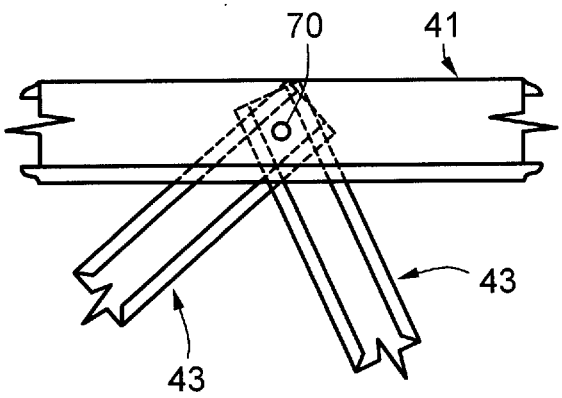
FIG. 6d
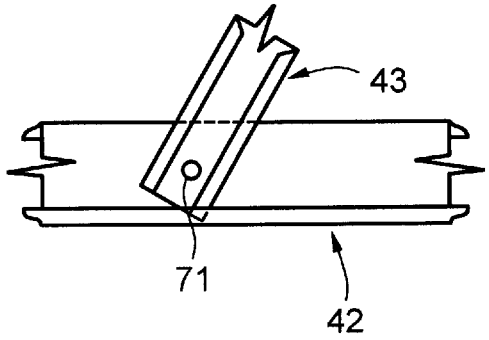
FIG. 6c
FIG. 6e
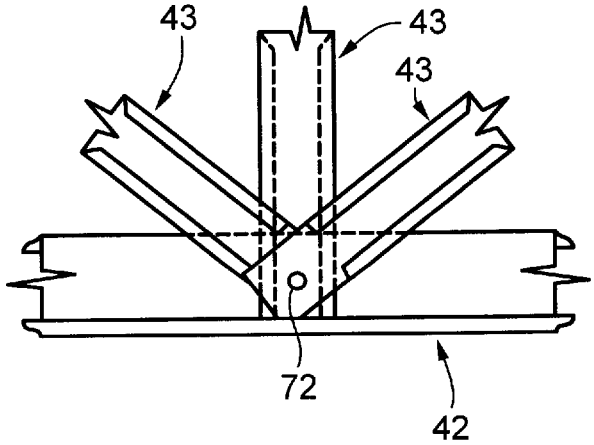

FIG. 8a
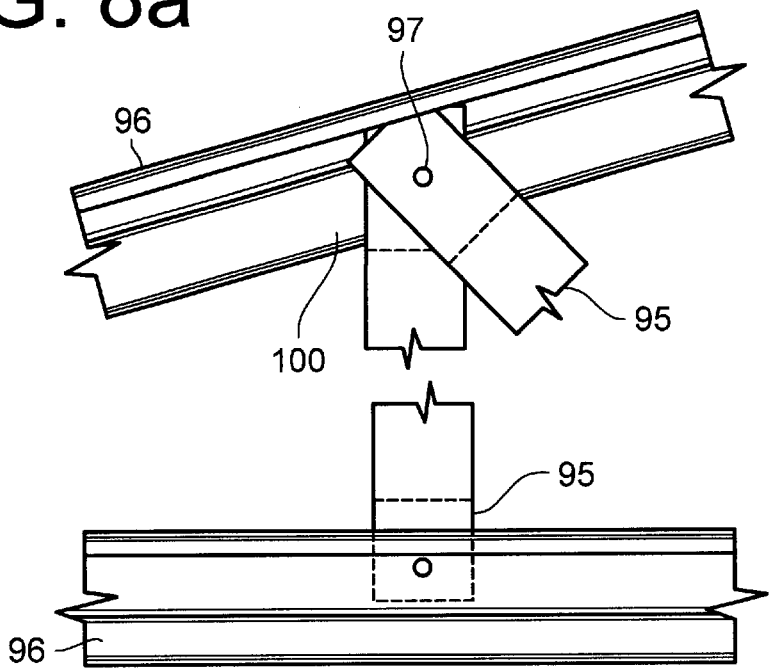
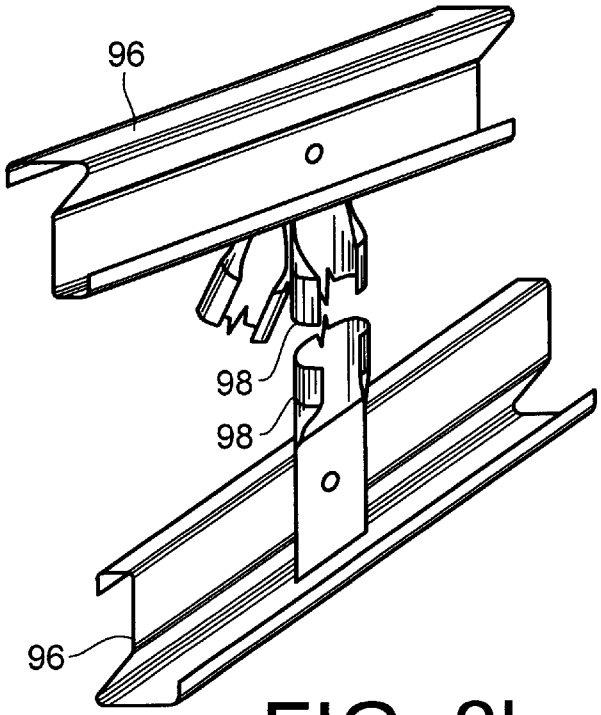
FIG. 8b
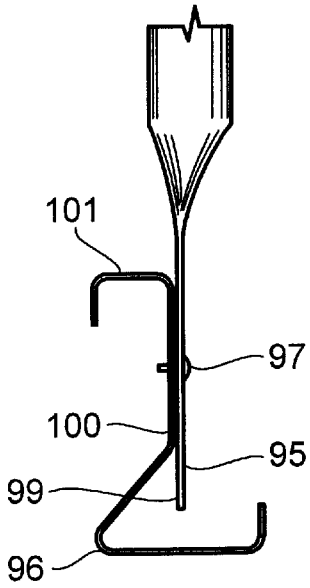
FIG. 8c

STRUCTURAL MEMBER

FIELD OF THE INVENTION

This application is the national phase under 35 U.S.C. §371 of PCT International Application No. PCT/AU98/00316 which has an International filing date of Apr. 30, 1998 which designated the United States of America.

The invention relates to a structural member for construction of buildings such as houses. The invention has particular but not exclusive application in use as a chord for forming a roof truss for a building.

PRIOR ART

A metal roof truss is commonly constructed with box-section chords and C-section web members. The box-section chords are formed by two C-sections individually roll formed and then further fabricated by dimple formation for locating and/or fastening by welding, riveting, hole punched and bolted or screwed to close the two C-sections. The fabrication of the section is a specialised operation and adds additional cost and time to the manufacture of a chord.

Open sections are generally quicker and cheaper to manufacture than box-sections comprising two C-sections, but they lack the strength and stiffness required for chords. Thus, whenever open sections, such as channel and Z-sections are used in the fabrication of building frames and roof trusses, additional precautions such as providing oversized sections or additional structural support must be taken to compensate for their inherent strength deficiencies. This of course increases the cost of many structures formed therefrom.

In addition, effecting the joints between top and bottom chords and between web members and chords mostly requires specialised joining members or shaping for welding which adds to the cost and complexity of such structures.

SUMMARY OF THE INVENTION

It is an object of this invention to provide an alternative structural member suitable for forming the chord of a truss or other structural member.

In one aspect the invention broadly resides in an elongated open structural member having a cross-section including a minor flange, a major flange and a web interconnecting said flanges and having a section axis at right angles to the longitudinal axis of the structural member and passing through the flanges and wherein:

said web includes a linear portion which extends substantially coincident with the section axis but substantially less than the length of the section axis between the flanges, and a divergent portion which extends to one side of said section axis;

said minor flange extends to said one side of said section axis;

said major flange extends from said divergent portion to the opposite side of said section axis, and the section configuration being such that an inverted and reversed corresponding open structural member is nestable within said open structural member with their respective linear portions overlapping each other and with each minor flange located in an abutting relationship against the underside of the adjacent major flange.

In another aspect the invention broadly resides in an elongated open structural member having a cross-section including a minor flange, a major flange, and a web interconnecting said flanges and having a section axis at right angles to the longitudinal axis of the structural member and passing through the flanges and wherein:

said web includes a linear portion which extends substantially coincident with the section axis but substantially less than the length of the section axis between the flanges, and a divergent portion which extends to one side of said section axis;

said minor flange laterally extends from said section axis to said one side;

said major flange extends from said divergent portion to the opposite side of said section axis, and the section configuration being such that an inverted and reversed corresponding open structural member is nestable within said open structural member with their respective linear portions overlapping each other and with each minor flange locatable in an abutting relationship against the underside of the adjacent major flange.

The linear portion may be any suitable length but preferably it extends along a major portion of the section axis between the flanges. The term "suitable" is qualified by the particular use of the open structural member and where a corresponding member is used the length of the linear portion is such that it enables the linear portions to overlap.

The divergent portion may have any suitable shape. The divergent portion may be curved, straight, or include a series of straight segments. In a preferred embodiment the divergent portion is a single straight portion that diverges from the section axis at an acute angle.

Preferably the major flange extends at an acute angle from the divergent portion. When the open structural member is used as a chord with the major flange outermost, the linear portion being substantially less than the length of the section axis between the flanges provides an advantage that the divergent portion acts in part like a spring to withstand compression forces substantially acting in the direction of the section axis and thereby resist deformation of the major flange.

The linear portion connects to the minor flange at its end opposite the divergent portion. Preferably the minor flange extends from the linear portion at an angle of substantially 90 degrees. Alternatively, the linear portion may include a second divergent portion which extends to the minor flange. The second divergent portion may be curved, straight, or comprise a series of straight segments.

The minor flange is preferably shorter than the major flange and most preferably is shorter than the section of the major flange which extends between an intersection with the section axis and the major flange, and its free end. Preferably the intersection with the section axis occurs about midway across the major flange.

Preferably the flanges are substantially parallel or at least parts which are substantially diagonally opposite with respect to the section axis are substantially parallel. Preferably the major flange is substantially parallel with the minor flange.

Preferably the open structural member includes limiting means to restrict lateral movement with respect to the section axis of connected members along the section axis. Preferably the limiting means is a return flange extending along the free edge of the major flange.

The major and/or the minor flanges preferably both terminate in a return flange. The return flange preferably returns substantially parallel to the section axis. Preferably the return flange of the major flange is spaced further from the section axis than the free end of the minor flange so that a reversed and inverted corresponding open structural member may nest within the structural member.

The open structural member is preferably asymmetrical in shape and allows the nesting of an inverted and reversed corresponding open structural member with the minor flange of one open structural member locatable within the major flange of the other open structural member and overlapping of the linear portions.

In another aspect the invention resides in a chord member for a truss, the chord member being an open structural member as described above whereby the chord member may be disposed with its major flange outermost and with interconnections between intersecting chord members being made by overlapping respective linear portions with the minor flange of one chord member being substantially adjacent the underside of the major flange of the other chord member and the overlapping of the linear portions enabling through fastening of the respective chord members. In such arrangement the webs overlap at joints for connection to one another such as by bolting or screwing or welding and, if desired disposed with their minor flanges nested within the major flanges of the opposing chord member.

It is also preferred that the chords of said truss are interconnected by truss members which may be open section members suitably terminated for web to web connection to the webs of the top and bottom chord members.

The assembled truss with the open structural member forming the top and bottom chord members with C-section truss members preferably has the chord members proud of the truss members thereby allowing stacking of the assembled truss and transportation of the stacks without risk of damage to the truss members by the overlying chord members. In contrast conventional box section chords have C-section truss members joined at their flat surfaces thereby causing the truss members to be proud of the chord members and exposing the truss members to damage during stacking and their transportation.

In a further aspect the invention broadly resides in a composite beam formed by the nesting of two open structural members as described above in an inverted and reversed orientation with respect to each other with the minor flange of one member located within the major flange of the other member and overlapping of the linear portions and fastening means connecting the open structural members together.

The open structural members may be prevented from lateral displacement with respect to one another by the fastening means but preferably they include returns along the free edges of the major flanges which restrain lateral displacement of the open structural members with respect to one another.

Preferably the nesting of the open structural members as described above forms two substantially closed sections thereby providing strength to the beam.

BRIEF DESCRIPTION OF THE DRAWINGS

Several typical embodiments of the invention will now be described by way of example with reference to the accompanying drawings in which:

FIGS. 6*b–g* shows various connections on the truss shown in FIG. 6*a;*

FIGS. 8*a–c* are views of different attachments of C-section truss members to a chord;

DETAILED DESCRIPTION OF THE PREFERRED EMBODIMENTS

Figure 1:
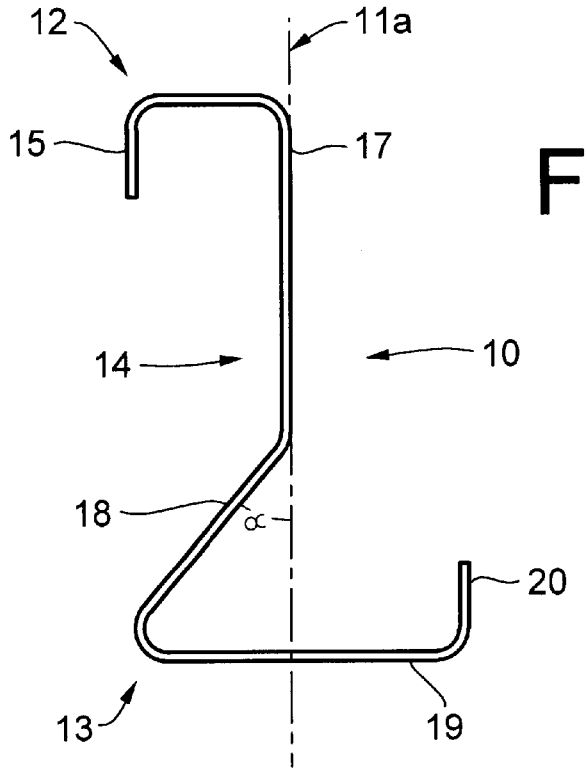
FIG. 1 is an end elevation of an elongate open structural member.
Figure 2:
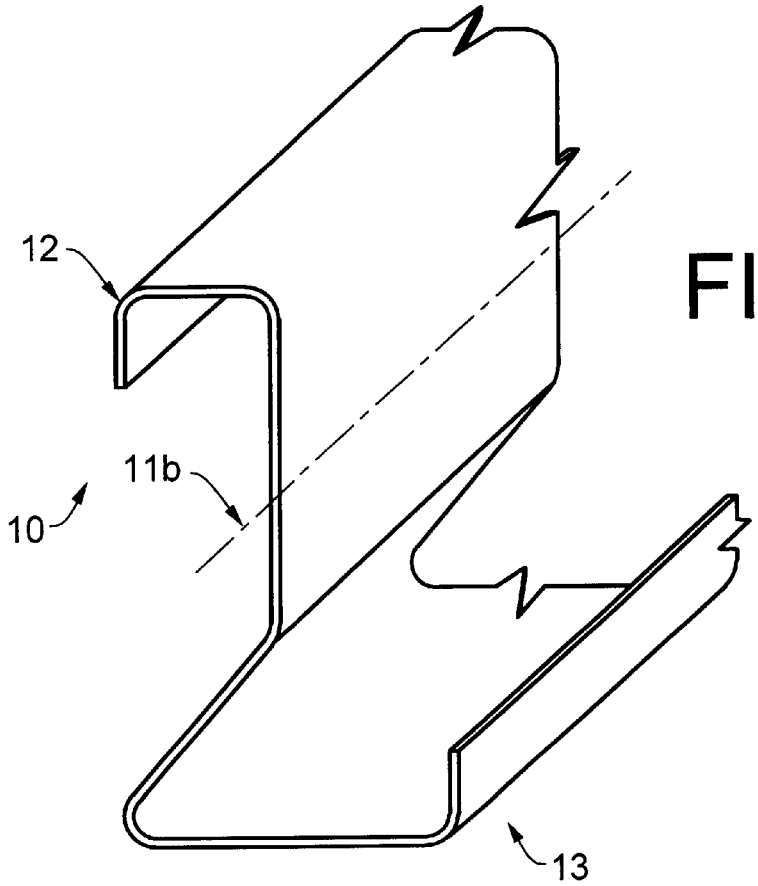
FIGS. 2,3, 4 are perspective views of the member.
Figure 3:
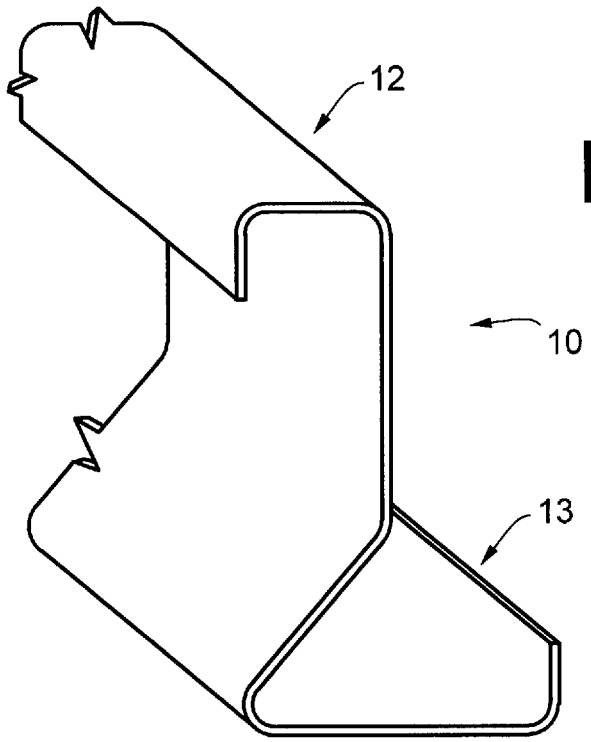
Figure 4:
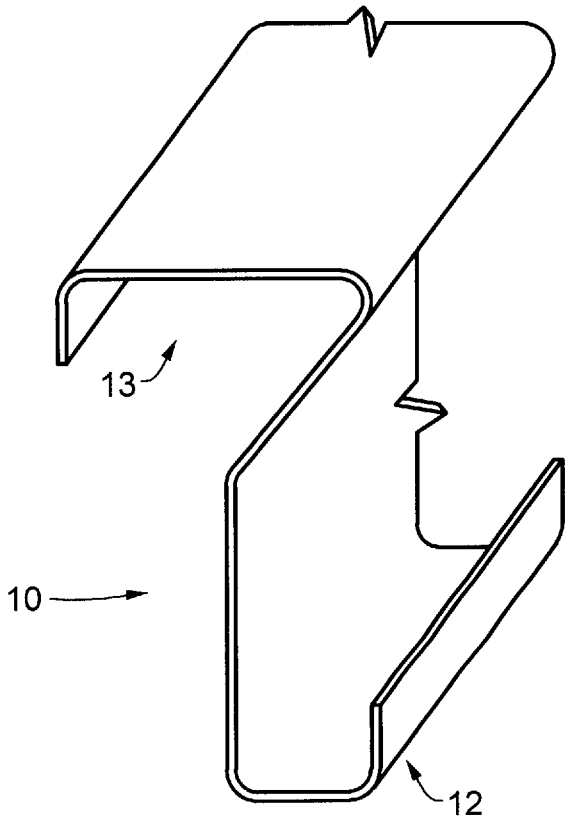

With reference to FIGS. 1, 2, 3 and 4 there is shown an elongate open structural member 10 having a minor flange 12 and a major flange 13 separated by a web 14. A longitudinal axis 11*b* of the member 10 is shown in FIG. 2. The web 14 includes a planar portion 17 and a divergent portion 18. A section axis 11*a* is coincident with the linear portion 17.

The minor flange 12 extends from the planar portion 17 at 90 degrees. The minor flange 12 includes a return flange 15. The return flange 15 is parallel to the section axis 11*a*.

The divergent portion 18 diverges from the section axis ll*a* at an acute included angle indicated by alpha. The divergent portion 18 is connected to the major flange 13. The major flange 13 includes a broad planar flange portion 19 which is connected to the divergent portion 18 forming an acute included angle. The major flange 13 also includes a return flange 20 parallel to the section axis.

Figure 5:
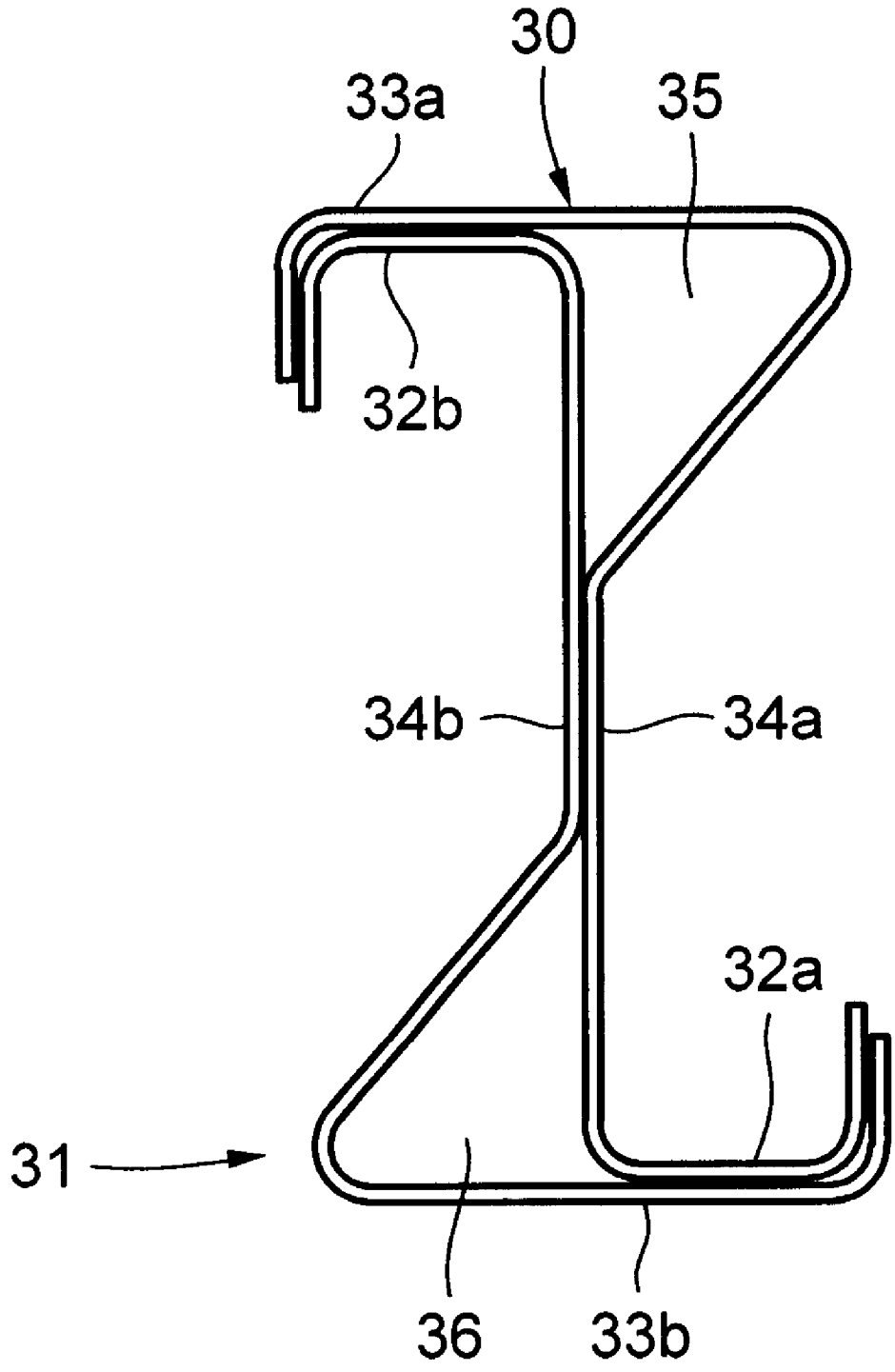
FIG. 5 is an end elevation of two members nested in reverse and inverted orientation with respect to each other.

As shown in FIG. 5, two elongate open structural members 30, 31 as described above are able to be nested with one member being in reverse and inverted orientation with respect to the other. To effect nesting minor flanges 32*a* and 32*b* are located within major flanges 33*b* and 33*a* respectively in abutting relationship. In this position the respective web portions 34*a*, 34*b* partly overlie each other thereby allowing fasteners to join both members 30, 31 to prevent lateral movement. The abutting relationship of the respective flanges 32*a*, 32*b*, 33*a*, 33*b* prevents movement along the section axis. The nesting of the two elongate members forms two closed sections 35, 36 which provide strength and stiffening to the composite member.

Figure 6A:
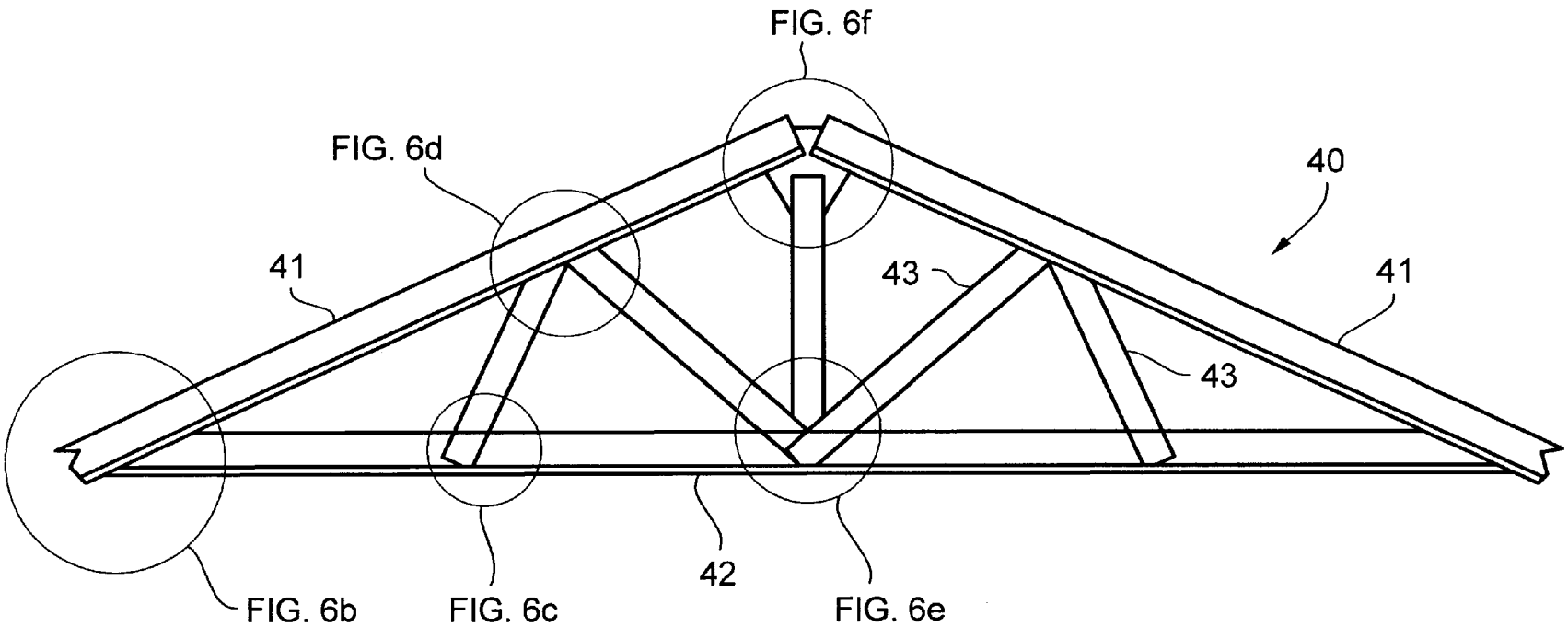
FIG. 6*a* is a front elevation of an assembled truss with open structural members as top and bottom chord members.
Figure 9A:
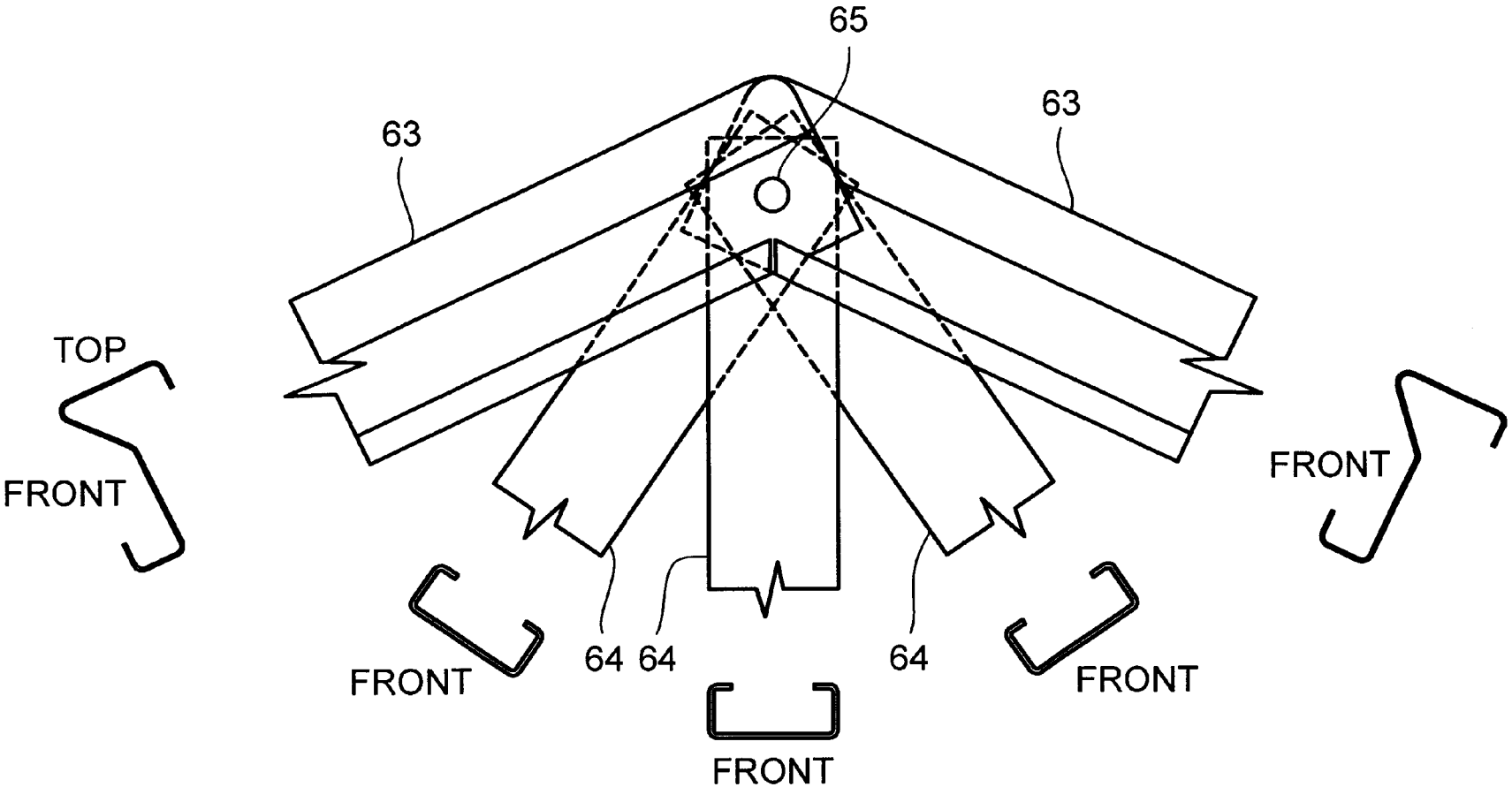
FIGS. 9*a–c* show alternative connections between chords and truss members.
Figure 9B:
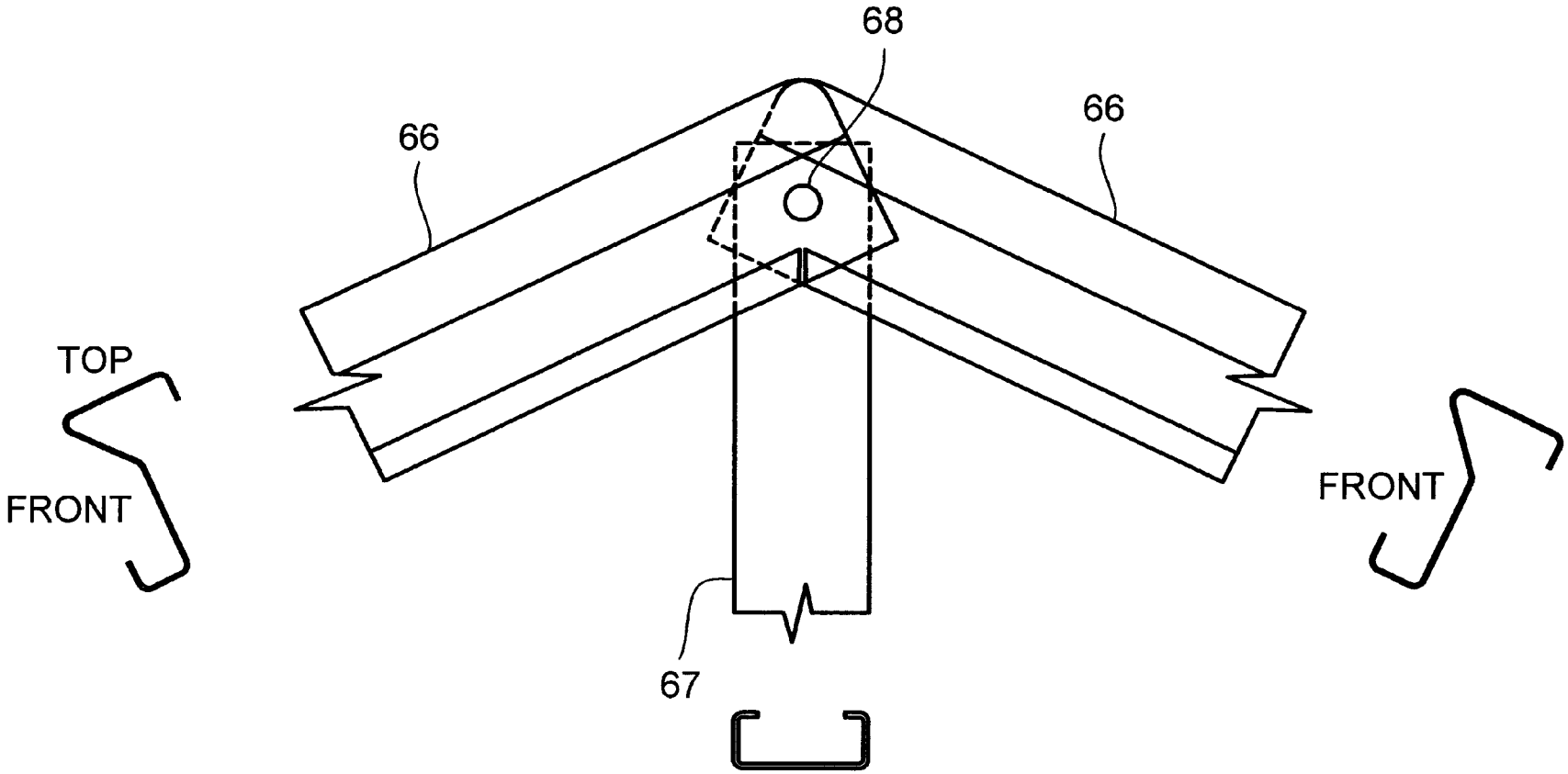
Figure 9C:
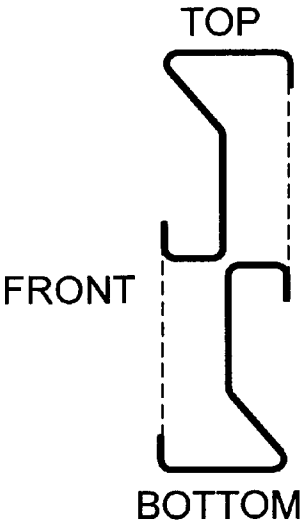
Figure 9C:
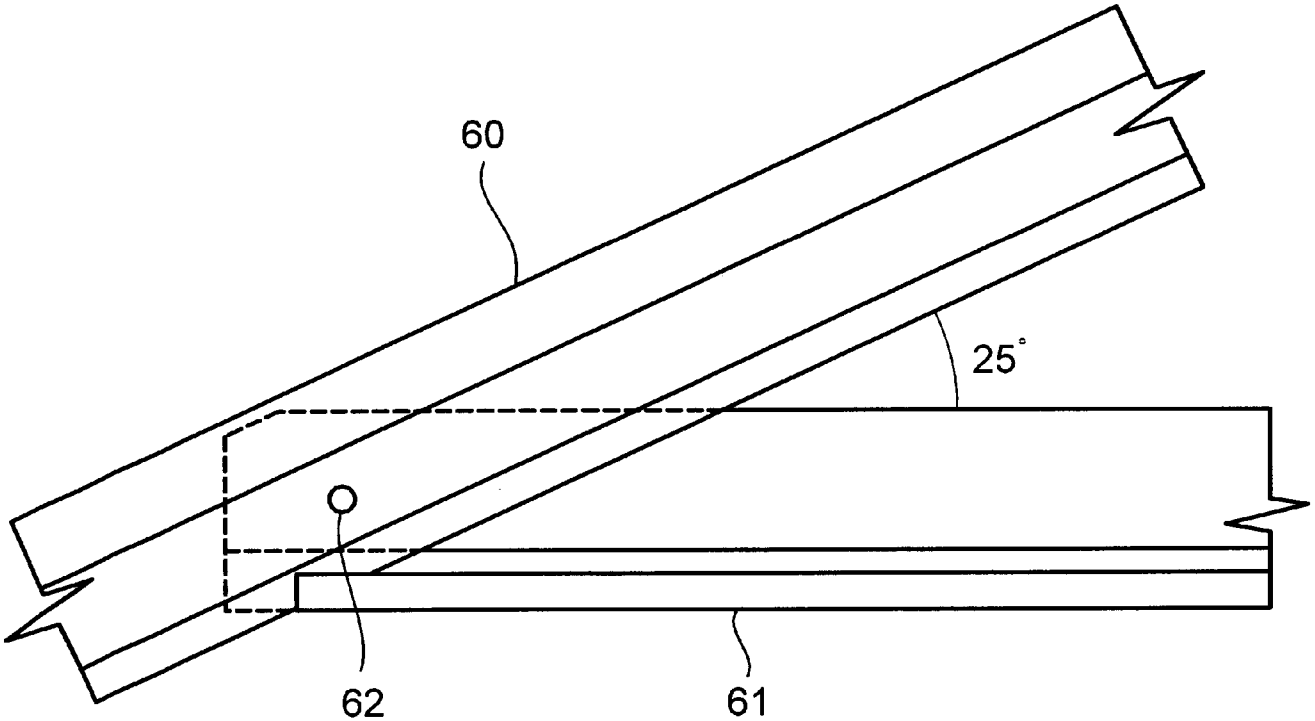
Figure 10A:
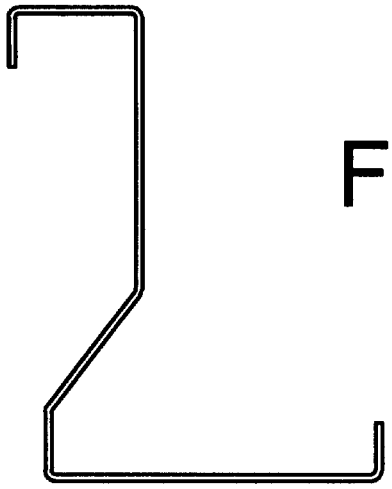
FIGS. 10*a–c* show an alternative structural members.
Figure 10B:
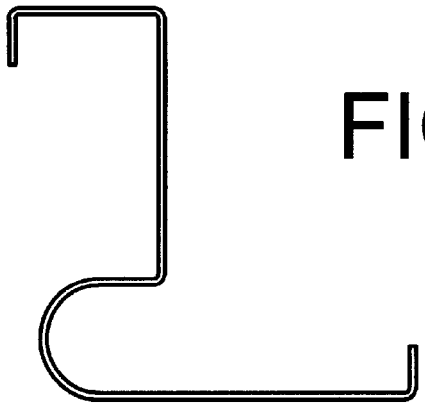
Figure 10C:
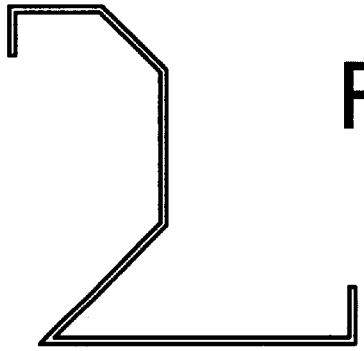

Roof trusses 40 as shown in FIGS. 6*a–g* are constructed with elongate open structural members forming top and bottom chords 41,42 and C-section truss members 43. The connection of the top chord 41 to the bottom chord 42 is shown in FIG. 6*b*. The major flanges 44,45 of the top and bottom chords 41 and 42 respectively are outermost. The minor flange 46 of the top chord 41 is partially located and confined in major flange 45. The rearward flat side 47 of top chord 41 partly overlaps frontward flat side 48 of the bottom chord 42. There is shown an intermediate connection plate 49 between sides 47 and 48. The connection plate 49 is attached to the bottom chord 42 by bolts 50, 51 and to the top chord 41 by bolts 50, 52. An alternative connection is shown in FIG. 9c where top chord 60 is bolted to bottom chord 61 at 62.

Figure 6F:
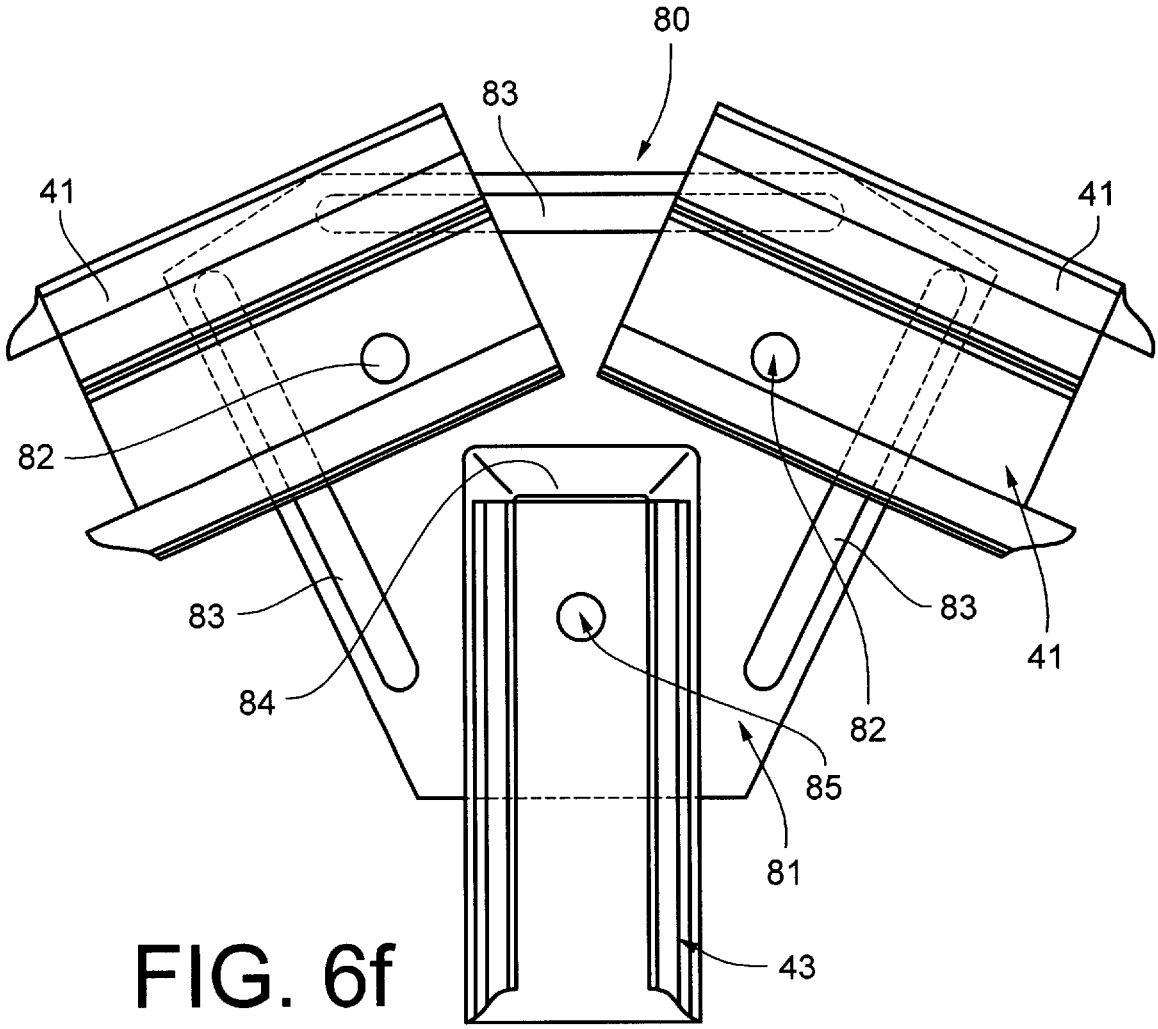

Connections of the truss members 43 to the chord members 41,42 are shown in FIGS. 6*c*, 6*d*, 6*f*. In FIG. 6*d* the truss members 43 are crimped and joined to the top chord 41 by bolt 70. In FIG. 6*e* the truss members 43 are attached to the bottom chord 42 by bolt 72. The underlying truss members are at least crimped to accommodate the connection. The connection shown in FIG. 6*c* has the truss member 43 connected by bolt 71 to the bottom chord 42. The chords 41,42 are proud of the truss members 43 in the truss 40.

Figure 6G:
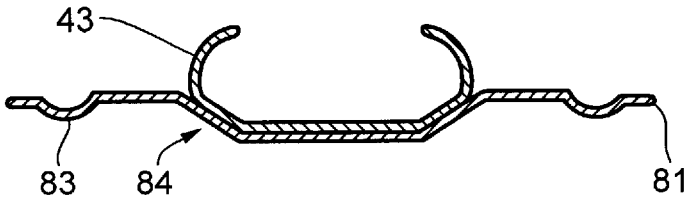

The apex 80 of the truss 40 is shown in FIGS. 6*f*, 6*g*. An apex plate 81 serves to connect top chords 41 by bolts 82.

The apex plate 81 has recessed ribs 83 to provide additional stiffening. The apex plate 81 also has a recess 84 for the location of a C-section truss member 43. The C-section truss member 43 is connected to the apex plate 81 by bolt 85. Alternative connections in an apex are shown in FIG. 9*a* and 9*b*. In FIG. 9*a* top chords 63 and C-section truss members 64 are connected by bolt 65. Similarly in FIG. 9*b* the top chords 66 and C-section truss member 67 are connected by bolt 68.

Figure 7A:
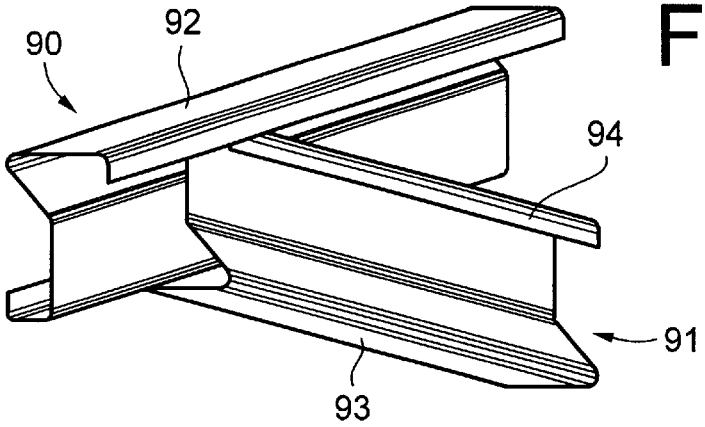
FIGS. 7*a–c* are views of the interconnection of two open structural members.
Figure 7B:
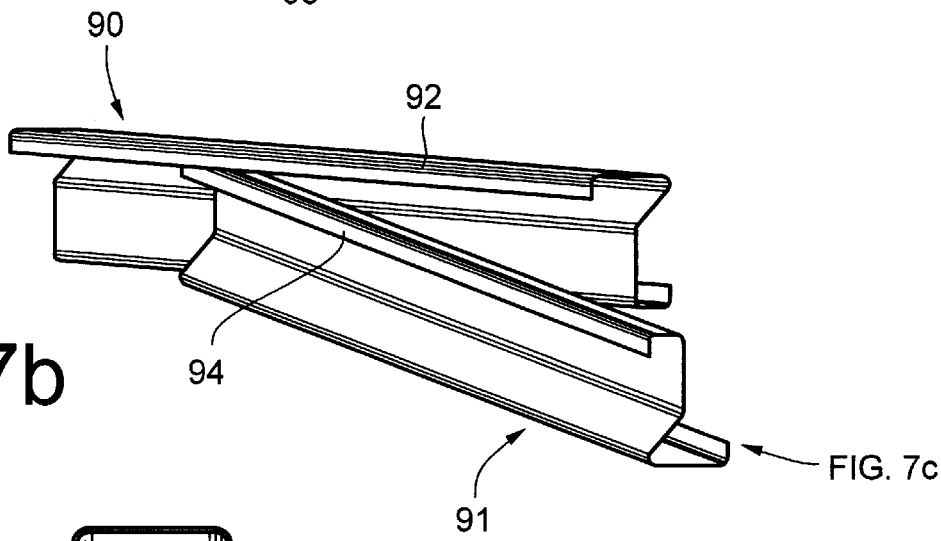
Figure 7C:
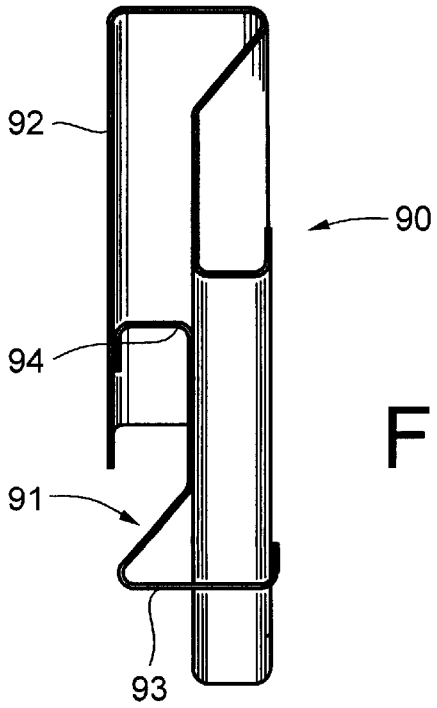

In FIGS. 7*a–c* there is shown chords 90,91 with major flanges 92,93 outermost and minor flange 94 located partially within the major flange 92.

In FIGS. 8*a–c* there is shown attachment of crimped C-section truss members 95 to elongate open structural member chords 96 by bolts 97. The C-section truss member 95 has end 98 crimped presenting a flat surface 99 for connecting to the chord 96. The flat surface 99 is attached to the side of the web portion 100 opposite the narrow flange 101.

The embodiment described above provides a number of advantages including efficient roll forming for chord production; provision of a strengthened and stiffer open section member chord with proper orientation of the major flange outermost; the ability to treat or coat the entire chord or composite beam or truss having open sections prior to use; compact truss stacking with chords being proud of truss web members thereby minimising damage to the truss members during transportation and reducing transport and storage costs; the ability of the chords to overlap for interconnection while maintaining the overlapped chords in line one above the other for symmetry of the truss and to be easily fastened together at terminations.

It will of course be realised that while the foregoing has been given by way of illustrative example of this invention, all such and other modifications and variations thereto as would be apparent to persons skilled in the art are deemed to fall within the broad scope and ambit of this invention as is herein set forth.

What is claimed is:

1. An elongated structural member having a cross-section including a minor flange, a major flange, and a web interconnecting said flanges and having a section axis at right angles to the longitudinal axis of the structural member and wherein:

said web includes a linear portion, which extends substantially coincident with the section axis, and a divergent portion which extends to one side of said section axis;

said minor flange laterally extends from said section axis to said one side;

said major flange extends from said divergent portion to the opposite side of said section axis and includes a major flange return which is spaced from the opposite side of the section axis by an amount substantially corresponding to the minor flange extends from the one side of the section axis, and the section configuration of the structural member being shaped such that a correspondingly shaped structural member can be inverted, inclined and nested with said structural member with the respective linear portions abutting each other and with each minor flange in an abutting relationship with the adjacent major flange whereat it is partially confined by the corresponding major flange return such that separation of the abutting linear portions is prevented.

2. An elongate structural member as claimed in claim 1 wherein said linear portion extends from the minor flange along a major portion of the section axis between the flanges and said divergent portion extends at an acute angle from the section axis.

3. A truss including upper and lower chords formed by elongate structural members as claimed in claim 2, wherein the longitudinal axes of the upper and lower chords are inclined at an acute angle with respect to each other and wherein the linear portions abut adjacent the eave line of the truss for connection to one another and the minor flange of each one of the chords abuts the major flange of the other chord at the eave line and is partially confined by the major flange return of the other chord such that separation of the abutting linear portions is prevented.

4. An elongate structural member as claimed in claim 1 wherein the minor flange includes a minor flange return, the minor flange return being adapted to abut a major flange return of an inverted and inclined like-sectioned structural member nested therein.

5. A truss including upper and lower chords formed by elongate structural members as claimed in claim 4, wherein the longitudinal axes of the upper and lower chords are inclined at an acute angle with respect to each other and wherein the linear portions abut adjacent the eave line of the truss for connection to one another and the minor flange of each one of the chords abuts the major flange of the other chord at the eave line and is partially confined by the major flange return of the other chord such that separation of the abutting linear portions is prevented.

6. A truss including upper and lower chords formed by elongate structural members as claimed in claim 1, wherein the longitudinal axes of the upper and lower chords are inclined at an acute angle with respect to each other and wherein the linear portions abut adjacent the eave line of the truss for connection to one another and the minor flange of each one of the chords abuts the major flange of the other chord at the eave line and is partially confined by the major flange return of the other chord such that separation of the abutting linear portions is prevented.

7. A chord for a truss, the chord including in section:

a web including a linear portion;

a minor flange connected to the web extending from the web in a first direction; and a major flange connected to the web, extending from the web in a second direction opposite the first direction and spaced from and parallel to the minor flange, the major flange including a major flange return;

wherein the chord is configured such that a second like-sectioned chord can be inverted, inclined and nested with the chord, with the respective linear portions of the webs abutting and with the minor flange of each chord abutting the major flange of the other chord and partially confined by the major flange return of the other chord whereby separation of the abutting linear portions of the webs is prevented.

8. A truss including a pair of chords as claimed in claim 7, an upper chord having the major flange uppermost, and a lower chord having the major flange lowermost, wherein the longitudinal axes of the upper and lower chords are inclined with respect to each other and wherein the upper and lower chords intersect and nest together at the eave line.

9. A chord for a truss, the chord including in section:

a web including a linear portion;

a minor flange connected to the web and extending from the web in a first direction; and a major flange connected to the web, and spaced from and parallel to the minor flange, the major flange extending from the web in a second direction opposite the first direction, the major flange including a major flange return, wherein the chord is configured such that a second like-sectioned chord can be inverted, inclined and nested with the chord, with the respective linear portions of the webs abutting and with the major flange and major flange return of each chord closely enveloping the minor flange of the other chord whereby separation of the abutting linear portions of the webs is prevented.

10. A truss including a pair of chords as claimed in claim 9, an upper chord having the major flange uppermost, and a lower chord having the major flange lowermost, wherein the longitudinal axes of the upper and lower chords are inclined with respect to each other and wherein the upper and lower chords intersect and nest together at the eave line.

11. A chord for a truss, the chord including in section:

a web including a linear portion;

a first flange connected to the web and having a lateral portion extending in a first direction;

a second flange connected to the web and spaced from and parallel to the first flange, the second flange including a lateral portion extending in a second direction different than the first direction and a second flange return;

wherein the chord is configured such that a second like-sectioned chord can be inverted, inclined and nested with the chord, with the respective webs abutting and with the first flange of each chord abutting the second flange of the other chord and partially confined by the second flange return of the other chord whereby separation of the abutting webs is prevented.

12. A truss including a pair of chords as claimed in claim 11, an upper chord having the second flange uppermost, and a lower chord having the second flange lowermost, wherein the longitudinal axes of the upper and lower chords are inclined with respect to each other and wherein the upper and lower chords intersect and nest together at the eave line.

13. A chord for a truss, the chord including in section:

a web including a linear portion;

a first flange connected to the web and having a lateral portion extending in a first direction;

a second flange connected to the web and spaced from and parallel to the first flange, the second flange including a lateral portion extending in a second direction different than the first direction and a second flange return;

wherein the chord is configured such that a second like-sectioned chord can be inverted, inclined and nested with the chord, with the respective webs abutting and with the first flange of each chord abutting the second flange of the other chord and partially confined by the second flange return of the other chord whereby separation of the abutting webs is prevented.

14. A truss including a pair of chords as claimed in claim 13, an upper chord having the second flange uppermost, and a lower chord having the second flange lowermost, wherein the longitudinal axes of the upper and lower chords are inclined with respect to each other and wherein the upper and lower chords intersect and nest together at the eave line.

15. A truss including:

a lower chord including in section:

a web having a linear portion and a divergent portion which extends to one side of the linear portion, a minor flange extending from the linear portion to the one side of the web, and a major flange extending from the divergent portion back to the other side of the web and including a major flange return;

an upper chord of the same section as the lower chord, wherein the upper chord is inverted and inclined with respect to the lower chord and wherein the upper and lower chords nest together at the eave line of the truss with the respective linear portions abutting and with the respective minor flanges abutting the respective major flanges and partially confined by the major flange returns.

16. A truss including:

a lower chord including in section:

a web, a minor flange, and a major flange;

an upper chord of the same section as the lower chord, wherein the upper chord is inverted with respect to the lower chord, and a line drawn through the longitudinal axis of the upper chord is not parallel to a line drawn through the longitudinal axis of the lower chord, and the upper and lower chords nest together at the eave line of the truss with the respective webs abutting and with the respective minor flanges abutting the respective major flanges.

17. A truss as claimed in claim 16, wherein the major flange includes a major flange return, the minor flange being partially confined by the major flange return such that separation of the abutting webs is prevented.

18. A truss including:

a lower chord including in section:

a web, a first flange, and a second flange;

an upper chord of the same section as the lower chord, wherein the upper chord is inverted with respect to the lower chord, and a line drawn through the longitudinal axis of the upper chord is not parallel to a line drawn through the longitudinal axis of the lower chord, and the upper and lower chords nest together at the cave line of the truss with the respective webs abutting and with the respective first flanges abutting the respective second flanges.

19. A truss as claimed in claim 18, wherein the second flange includes a second flange return, the first flange being partially confined by the second flange return such that separation of abutting webs is prevented.

20. A method of forming a truss including:

providing a pair of like-sectioned chords, each chord having in section a web, a minor flange and a major flange;

inverting one chord relative to the other and inclining the longitudinal axes of the chord with respect to each other and intersecting and nesting the chords at the eave line of the truss such that the respective webs abut and such that the respective minor flanges abut the respective major flanges.

21. A method as claimed in claim 20, wherein the major flange includes a major flange return, the minor flange being partially confined by the major flange return such that separation of abutting webs is prevented.

22. A method of forming a truss including:

providing a pair of like-sectioned chords, each chord having in section a web, a first flange and a second flange;

inverting one chord relative to the other and inclining the longitudinal axes of the chords with respect to each other and intersecting and nesting the chords at the eave line of the truss such that the respective webs abut and such that the respective first flanges abut the respective second flanges.

23. A method as claimed in claim 22, wherein the second flange includes a second flange return, the first flange being partially confined by the second flange return such that separation of abutting webs is prevented.

* * * * *